United States Patent [19]

Cohen

[11] Patent Number: 4,969,214

[45] Date of Patent: Nov. 13, 1990

[54] JACKET FOR DISPLAYING INFORMATION

[76] Inventor: Stephen Cohen, 1532 - 15th Ave. W., Seattle, Wash. 98119

[21] Appl. No.: 374,758

[22] Filed: Jul. 3, 1989

Related U.S. Application Data

[63] Continuation-in-part of Ser. No. 200,434, May 31, 1988, Pat. No. 4,875,237.

[51] Int. Cl.[5] ..... A41D 1/02

[52] U.S. Cl. ..... 2/94; 2/115; 2/246; 2/247; 2/102

[58] Field of Search ..... 2/94, 246, 247, 249, 2/115

[56] References Cited

U.S. PATENT DOCUMENTS

| | | | |
|---|---|---|---|
| 2,647,261 | 8/1953 | Rassner | 2/246 |
| 2,871,485 | 2/1959 | Greco | 2/246 |
| 3,055,133 | 9/1962 | Anderson | 2/246 |
| 3,381,307 | 7/1968 | Shingler | 2/94 |
| 4,710,981 | 12/1987 | Sanchez | 2/246 |

*Primary Examiner*—Werner H. Schroeder
*Assistant Examiner*—Gloria Hale
*Attorney, Agent, or Firm*—David L. Garrison

[57] ABSTRACT

A jacket comprising a pair of front panels, a back panel, a collar, and sleeves. The outer surface of the jacket having vent panels attached to front and rear panels which create accessible, upwardly extending vent panel pockets. Inside each vent panel pocket is a detachable flexible informational display panel which can be stored inside each pocket and hidden from view. When the situation arises, the flexible informational display panel can be repositioned and extended downwardly below the vent panel pocket and used to display information.

6 Claims, 6 Drawing Sheets

JACKET FOR DISPLAYING INFORMATION

This application is a Continuation-in-Part of U.S. Ser. No. 07/200,434, filed on May 31, 1988, now Pat. No. 4,875,237.

TECHNICAL FIELD

This invention relates to articles of outer clothing such as jackets, vests, coats and the like. More particularly, this invention relates to outer clothing having permanently or temporarily attached informational display panels with can be selectively stowed and displayed therefrom.

BACKGROUND ART

There are various ways to communicate information on the visible, exterior surfaces of outer clothing such as jackets, coats, vests and the like. The form and content of the communication, of course, can vary greatly. The words or symbols themselves may be attached either permanently or temporarily to the garment's exterior surface. A common example of this is a baseball jacket with words or symbols printed or embroidered on its front or rear panels. Alternatively, the words or symbols may be permanently or temporarily attached to a secondary structure, such as a panel or sign, which itself may be attached to the garment's outer surface. An example of this is the number sign used by track meet contestants. There are, however, drawbacks to these methods which this invention addresses.

One drawback of having information attached permanently to the garment's exterior surface is the loss of versatility. Garments having information designed for a particular audience or purpose attached to the front or rear panel of the garment may not be desirable for continuous wear by the user. A police jacket, for instance, having the words "Police" or "Police Department" printed on its front or rear panels would not be suitable to wear by an on-duty undercover policeman.

Two drawbacks of having the information temporarily attached to the exterior surface are: (1) the informational panel or sign must be physically attached or detached from the garment's surface; and (2) when detached, the informational panel or sign must be stored in a nearby location for future use.

Some advantages of having the informational display panel or sign temporarily attached to the exterior surface include: (1) the informational panel or sign may be removed and exchange for other panels or signs having different information printed on them and; (2) the informational display panel or sign may be removed and used independently from the garment.

There is a need for articles of outer clothing such as jackets, coats, vests and the like having informational display panels that may be permanently or temporarily attached to the outer clothing which can be quickly and conveniently stowed therein and selectively displayed. Such a means is provided in the following invention.

DISCLOSURE OF INVENTION

It is the general object of the present invention to provide an outer garment which can quickly and conveniently stow and selectively display informational display panels The present invention provides for a conventional appearing jacket with front and rear panels, sleeves, collars, waistband and pockets having accessible vent pockets which can stow and selectively display panels.

The jacket has two front panels and one rear panel. Each panel consists of an upper and lower portion attached at a panel seam. The upper portion of one or more of the panels is overlaid by a vent panel attached to the shoulder and collar which extends downwardly covering the upper panel and the panel seam. The lower edge of each vent panel may be attached to the underlying panel just below the panel seam by a suitable fastener creating an accessible, upward-extending vent pocket.

A informational display panel manufactured in various shapes and sizes may be stowed and concealed inside each vent pocket. A first edge or margin of the informational display panel may be permanently or temporarily attached to the panel seam located between each upper and lower panel. A temporary attachment means, such as a slide fastener or a hook or loop connector, is used to temporarily attach the informational display panel to the panel seam.

A second edge or free margin of the informational display panel is temporarily attached to the inside surface of the vent pocket at a site above the panel seam using suitable fasteners, such as hook and loop fasteners.

When the second edge cr margin is attached to the jacket, the informational display panel is held and extended upwardly inside the vent pocket and hidden from view. By detaching the second edge from the fastener located on inside surface of the vent pocket, the informational display panel may be extended downwardly through the vent pocket opening and displayed. When the wearer wants to discontinue the communication, the second edge or margin of the panel may be turned upwardly and extended through the vent pocket opening into the vent pocket and attached to the fastener. The vent pocket may be temporarily closed by a suitable fastener, such as a hook and loop connector, located on the lower edge of the vent panel.

When the first edge is unattached or temporarily attached to the panel seam using a temporary fastener, the display panel may be removed from the vent pocket. This allows the display panel to be used independently from the jacket and allows the wearer to exchange the display panel for another informational display panel.

The invention disclosed herein, thus provides for a jacket having permanently or temporarily attached informational display panels which can be stowed and selectively displayed or removed from the jacket.

BEST MODE FOR CARRYING OUT THE INVENTION

Referring specifically to the drawings, wherein like numerals indicate like parts, there is seen a jacket structure having a pair of front panels, 10 and 40, a rear panel 16, a pair of sleeves 3 and 5, a slide fastener 7 and a slide fastener pull 8.

Figure 1:
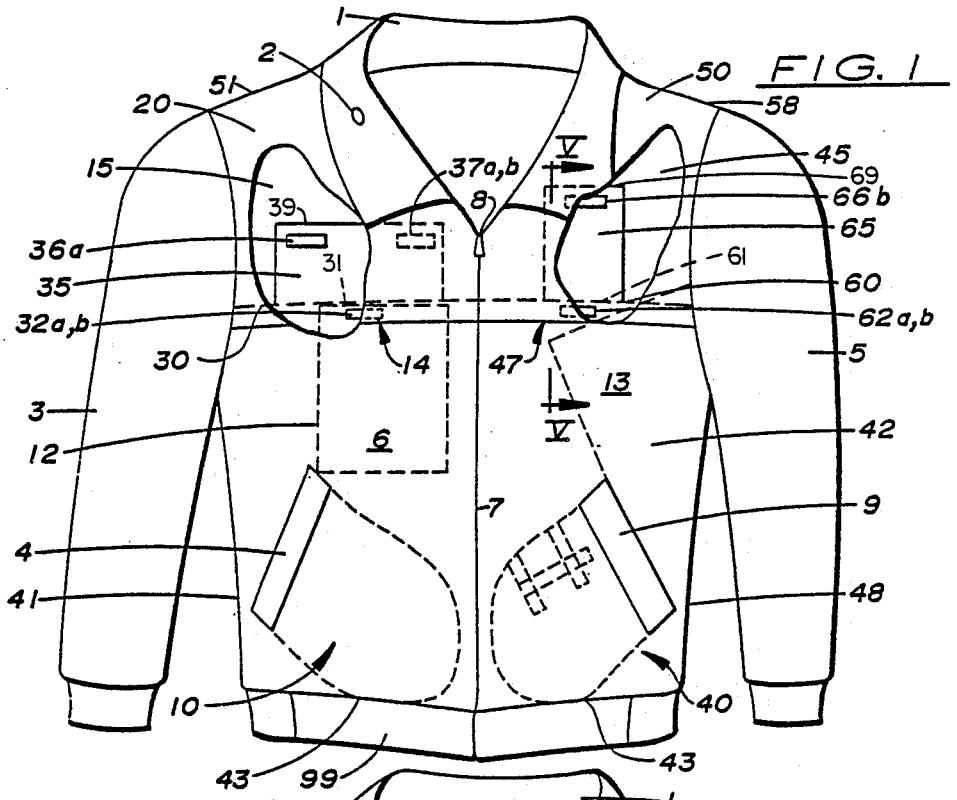
FIG. 1 is a front view of jacket with a portion broken away with front informational display panels extended upwardly inside front vent pockets and concealing information.

As shown in FIG. 1, right pocket 4 is attached to the right front panel 10 and left pocket 9 is attached to left front panel 40. Right inside pocket 6 is attached to the inside surface of right front panel 10 and is designed to hold a radio or walkie-talkie. Left inside pocket 13 designed to hold a large object such as a gun, is attached to inside surface of left front panel 40. Antenna hole 2 is located on the right flange of collar 1.

Figure 4:
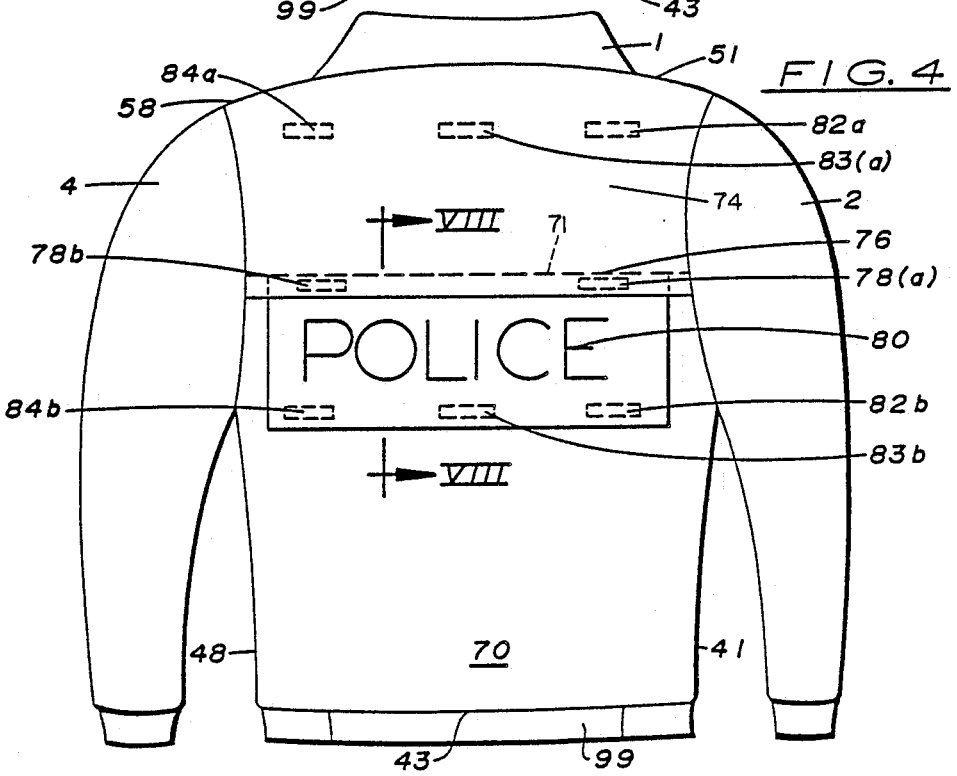
FIG. 4 is a ear view of jacket with informational display panel extended downwardly from rear vent pocket displaying information.

The right front panel 10 interconnects with the rear panel 16, shown in FIG. 4, at the shoulder seam 51 and side seam 41. The right front panel 10 interconnects with the right sleeve 3 and the slide fastener 7 and extends downwardly to interconnect with waistband 99 along seam 43. The right front panel 10 consists of two parts; a lower right front panel 12 attached to a upper right front panel 15 at right front panel seam 30. The right front panel seam 30 extends horizontally across the right front panel 10 from a point just above the armpit of the right sleeve 3 to slide fastener 7.

As shown in FIG. 1, the left front panel 40 interconnects with the rear panel 16, shown in FIG. 4, at the shoulder seam 58 and side seam 48. The left front panel 40 interconnects with the left sleeve 5 and the slide fastener 7 and extends downwardly to interconnect with waistband 99 along seam 43. The left front panel 40 consists of two parts; a lower left front panel 42 attached to an upper left front panel 45 at left front panel seam 60. The left front panel seam 60 extends horizontally across the left front panel 40 from a point just above the armpit of the left sleeve 5 to slide fastener 7.

As shown in FIG. 1, the right front vent panel 20 overlays the upper right front panel 15 The upper edge of right front vent panel 20 is attached to the right shoulder seam and extends downward covering the upper right front panel 15 and right front panel seam 30. The lower edge of right front vent panel 20 extends approximately horizontally from the armpit of right sleeve 3 to the slide fastener 7. The left edge of right front vent panel 20 attaches to collar 1 and to slide fastener 7 with the right edge of right front panel 20 attaching to right sleeve 3. Attaching the right front vent panel 20 in the above stated fashion creates an accessible, upwardly extending right front vent pocket 14 as shown in the broken away portion of right front vent panel 10 in FIG. 1. As shown in FIG. 1, hook and loop connectors 32A and 32B open and close right vent pocket 14. Hook connector 32B is located medially on lower right front panel 12 just below right front panel seam 30. Loop connector 32A is located on inside surface of right vent panel 20 across from hook connector 32B.

Figure 5:
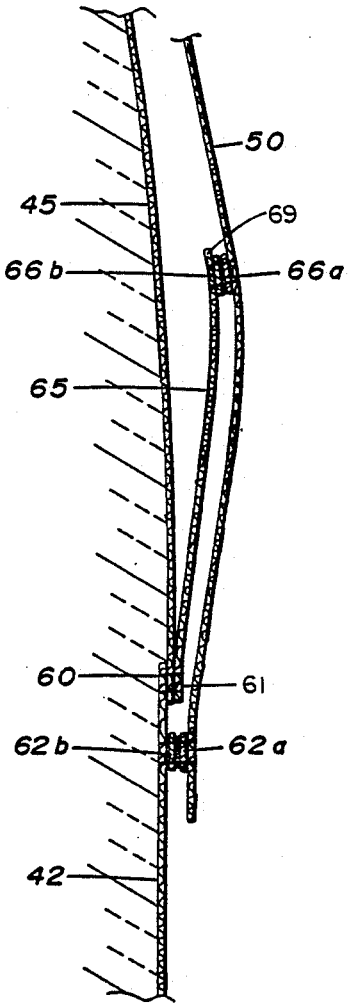
FIG. 5 is a cross-sectional view of the jacket shown in FIG. 1 taken along line 1—1 thereof.

As shown in FIG. 1, the left front vent panel 50 overlays the upper left front panel 45. The upper edge of left front vent panel 50 is attached to the left shoulder seam and extends downwardly covering the upper left front panel 45 and left front panel seam 60. The lower edge of left front vent panel 50 extends approximately horizontally from the armpit of left sleeve 5 to the slide fastener 7. The right edge of left front vent panel 50 attaches to collar 1 and to the slide fastener 7 with left edge of left front panel 50 attaching to left sleeve 5. Attaching the left front vent panel 50 in the above stated fashion creates an accessible, upwardly extending left front vent pocket 45 as shown in the broken away portion of the left vent panel 40 in FIG. 1. As shown in FIG. 5, hook and loop connector 62A and B open and close left vent pocket 47. Hook connector 62B is located medially on lower left front panel 42, just below left front panel seam 60. Loop connector 62A is located on the inside surface of left vent panel across from hook connector 62B.

Figure 2:
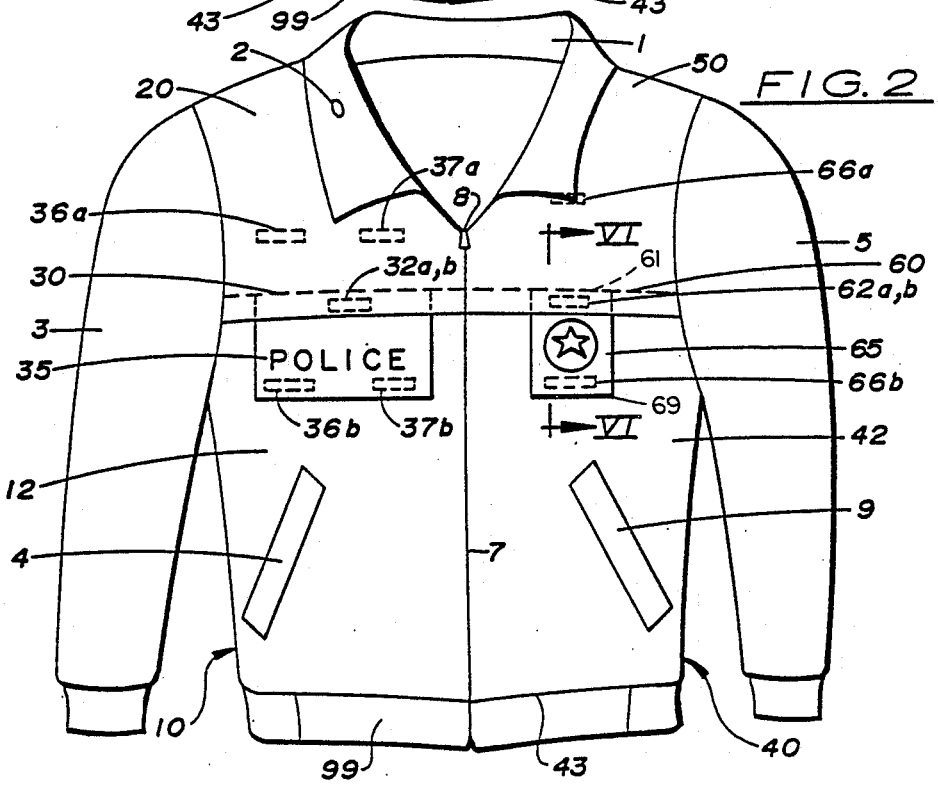
FIG. 2 is a front view of jacket with informational display panels extended downwardly from front vent pockets displaying information.

The right front informational display panel 35 is attached along a first edge 31 to the right front panel 10 at the right front panel seam 30. Display panel 35, when in the first position, extends upwardly into the right front vent pocket 14. Display panel 35 is held in first position by hook and loop connectors 36A, B and 37A, B as shown in FIG. 1. The second edge 39 of display panel 35 is attached to the inside surface of upper right front panel 20. By disconnecting hook and loop connectors 36A, B and 37A, B, the upwardly extending second edge 39 may be folded and extended downwardly below right front vent pocket 14 into a second position as shown in FIG. 2. While in this second position, any information printed on the exposed surface of display panel 35 is thereby displayed to the general public. By again extending upwardly display panel 35 into right vent pocket 14, the display panel 35 may be returned to its first position and concealed.

Figure 6:
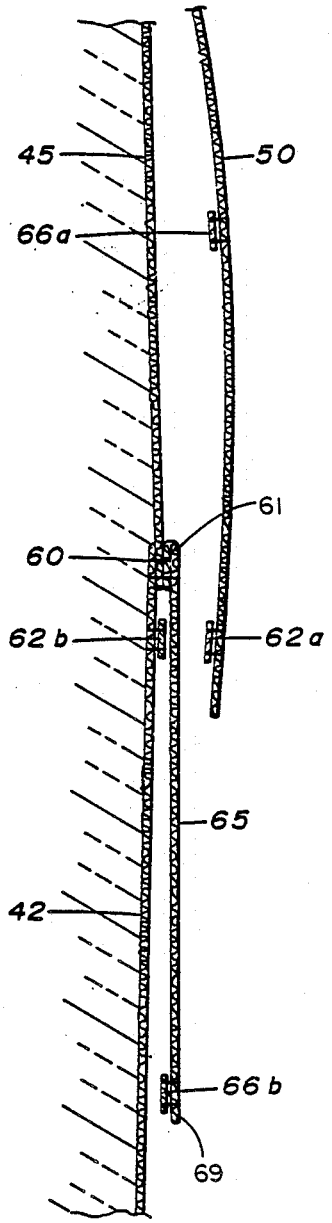
FIG. 6 is a cross-sectional view of the jacket shown in FIG. 2 taken along line 2—2 thereof.

The left front informational display panel 65 operates in a similar fashion as informational display panel 35. The left front informational display panel 65 is attached at a first edge 61 to the left front panel 40 at the left front panel seam 60. Display panel 65 when in first position, extends upwardly into left front vent pocket 47. Display panel 65 is held in the first position by hook and loop connectors 66A, B as shown in FIG. 1 and FIG. 5. The second edge 69 is attached to the inside surface of upper left front panel 50. By disconnecting hook and loop connector 66A, B, the second edge 69 of display panel 65 may be extended downwardly below left front vent pocket 47 into a second position as shown in FIG. 2 and 6. While in this second position, any information printed on the exposed surface of display panel 65 is thereby displayed to the general public. By again extending upwardly display panel 65 into left vent pocket 47, the display panel 65 may be returned to its first position and concealed.

As shown in FIG. rear panel 16 consists of a lower rear panel 70 and an upper rear panel 72 interconnected at rear panel seam 76. The rear panel 70 interconnects with front panels 10 and 40 along side seams and attaches to sleeve 3 and sleeve 5. A rear panel seam 76 extends horizontally across the rear panel 16 from points just above the armpits of right sleeve 3 and left sleeve 5. Upper rear panel 72 interconnects with front panels 10 and 40 at shoulder seam and connects to collar 1 and sleeves 3 and 5.

Figure 3:
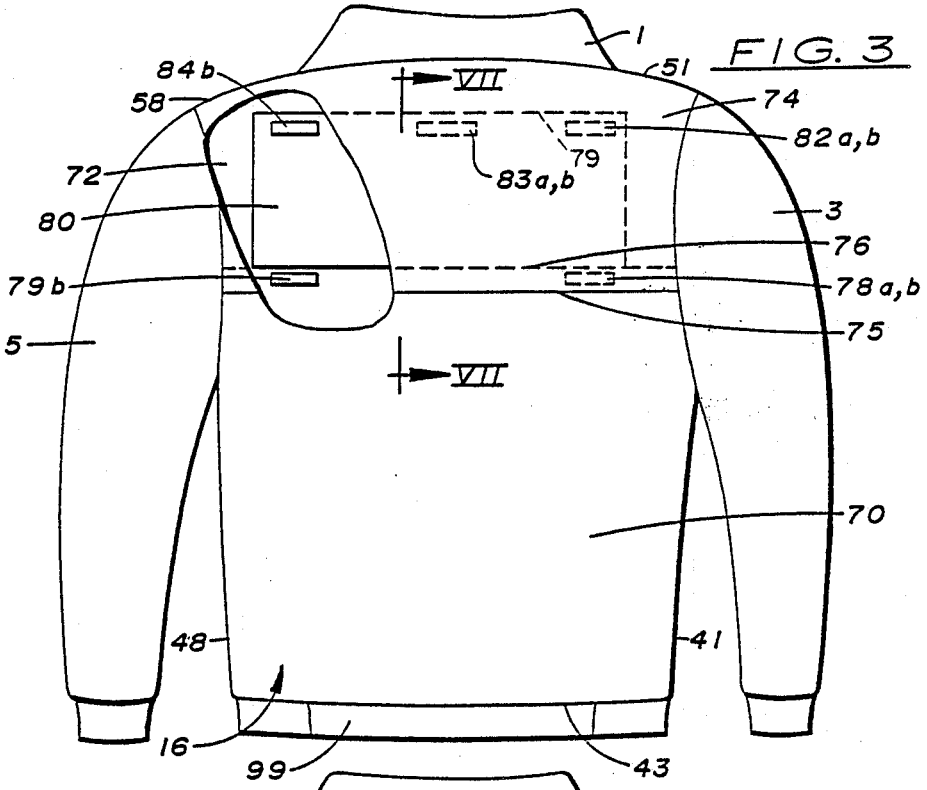
FIG. 3 is a rear view of jacket with a portion broken away with rear informational display panel extended upwardly inside rear vent pocket and concealing information.

As seen in FIGS. 3 and 4, the rear vent panel 74 stretches across the shoulders and extends downwardly covering the upper rear panel 72 and rear panel seam 76. The upper edge of rear vent panel 74 is attached at the shoulder seams, sleeves 3 and 5, and at the collar 1. Attaching the rear vent panel 74 in the above stated fashion creates an accessible, upwardly extending rear panel pocket 75 as shown in FIG. 3. Rear panel pocket 75 can be opened or closed by hook and loop connectors 78A, B and 79A, B located between lower rear panel 70 and the inside, lower edge of rear vent panel 74, just below rear panel seam 76, as shown in FIG. 7.

Figure 7:
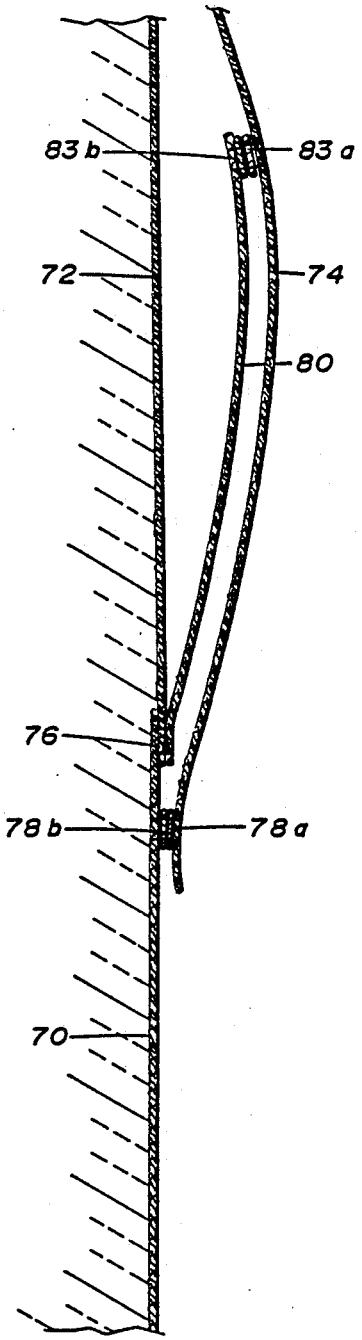
FIG. 7 is a cross-sectional view of the jacket shown in FIG. 3 taken along line 3—3 thereof.
Figure 8:
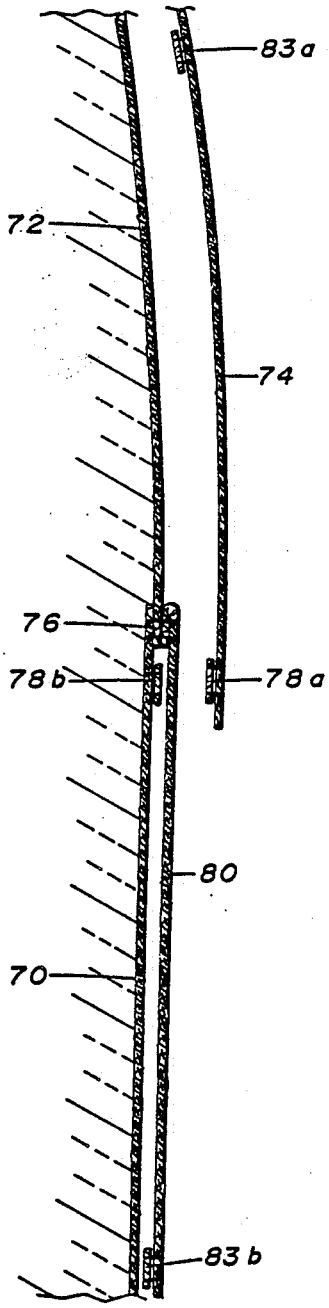
FIG. 8 is a cross-sectional view of the jacket shown in FIG. 4 taken along line 4—4 thereof.

As shown in FIG. 7 the rear informational display panel 80 is attached at a first edge 71 to the lower rear panel 70 at rear panel seam 76. Display panel 80 when in first position, extends upwardly into rear vent pocket 75 as shown in FIGS. 3 and 7. Display panel 80 is held in first position by hook and loop connectors 82A, B; 83A, B; and 84A, B, located between the second edge 79 of display panel 80 and the inside surface of upper rear panel 74. By disconnecting hook and loop connectors 82A, B; 83A, B; and 84A, B, the second edge 79 may be extended downwardly below rear panel pocket 75 into a second position. While in this second position, information printed on the exposed surface display panel 80 is displayed to the general public. By again extending display panel 80 upwardly into the rear panel pocket 75, display panel 80 may be returned to its first position and concealed.

Figure 9:
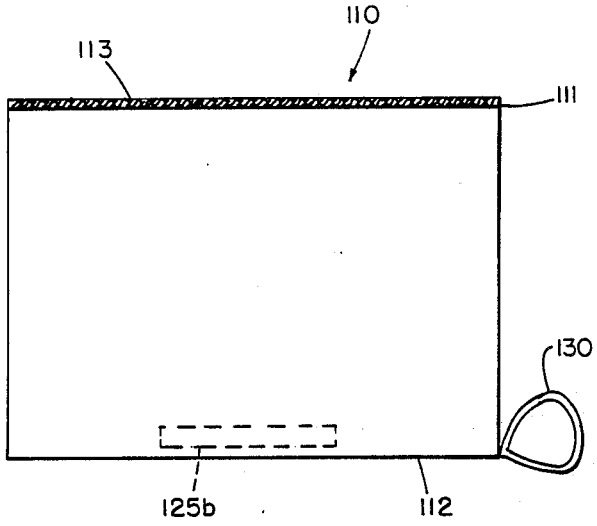
FIG. 9 is a front view of a removable informational display panel having a row of interlocking teeth for a slide fastener attached along the first detachable edge.
Figure 10:
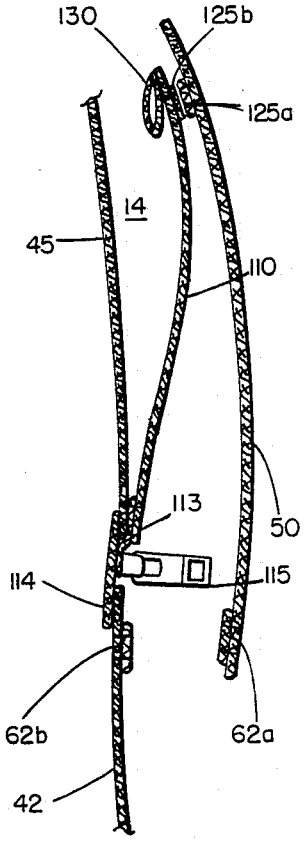
FIG. 10 is a cross-sectional view of the jacket similar to the view taken in FIG. 5 showing the removable informational display panel shown in FIG. 9 attached along the first detachable edge to a slide fastener disposed between the upper and lower panels.

In an alternative embodiment, each informational display panel disclosed herein may be modified to make it removable from the vent pocket. As seen in FIGS. 9 and 10, the informational display panel 110 has a first edge 111 and second 112 detachable edge. The first edge 111 may be unattached (not shown) or temporarily attached to the jacket using a temporary attachment means, such as a slide fastener 114 disposed between the upper 45 and lower 42 panels. The slide fastener 114 is has a slide pull 115 that engages with the interlocking teeth of slide fastener portion 113 to first edge 111.

Located along the second edge 112 of panel 110 is a loop connector 125*b* which engages with the hook connector 125(*a*) located on the inside surface of the vent panel 50 above the slide fastener 114. When the hook 125(*a*) and loop 125(*b*) connectors are engaged, the second edge is pulled upwardly, extending and holding the panel 112 inside the vent pocket 14. When the hook 125(*a*) and loop 125(*b*) are disengaged, the second 112 may be pulled downwardly and extended through the vent pocket opening for viewing.

When the wearer wants to remove the informational display panel 110 from the vent pocket 14, slide fastener portion 113 is disengaged form the slide fastener 114 by pulling slide fastener 115. Later, the panel 110 may be reattached to the vent pocket 14 by engaging slide fastener portion 113 with slide fastener 114. A second informational panel (not shown) having a compatible slide fastener portion may be attached in place of panel 110 to slide fastener 114.

Figure 11:
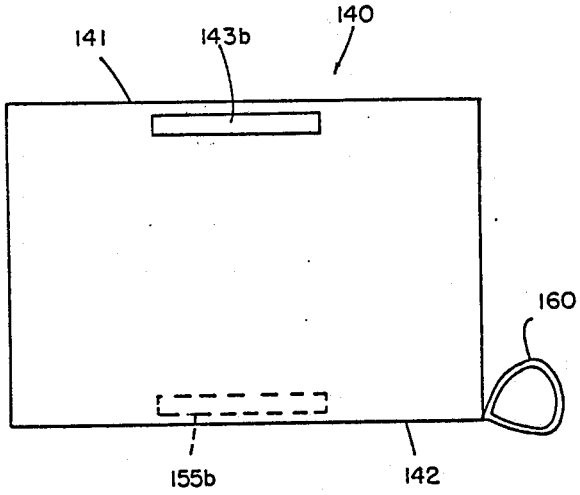
FIG. 11 is a front view of a removable informational display panel having a loop connector attached along the first detachable edge.
Figure 12:
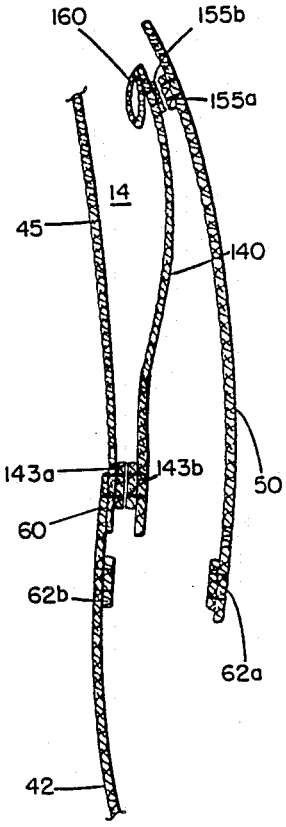
FIG. 12 is a cross-sectional view of the jacket similar to the view taken in FIG. 10 showing the removable informational display panel shown in FIG. 10 attached along the first detachable edge to a hook connector located on the panel seam between the between the upper and lower panels.

Alternatively, the temporary attachment means may include a hook and loop connector which attaches the first edge 111 to the vent pocket 14. As shown in FIGS. 11 and 12, a hook connector 143(*b*) may be attached to the first 141 of panel 140. Loop connector 143(*a*) is attached to panel seam 60 which engages with hood connector 143(*b*) and attaches the first edge 111 to the vent pocket.

Located along the second edge 141 of panel 140 is a loop connector 155(*b*) which engages with the hook connector 155(*a*) located on the inside surface of the vent panel 50 above the panel seam 60. When the hook 155(*a*) and loop 155(*b*) connectors are engaged, the second edge is pulled upwardly, extending and holding the panel 140 inside the vent pocket 14. When the hook 155(*a*) and loop 155(*b*) are disengaged, the second edge 140 may be pulled downwardly and extended through the vent pocket opening for viewing.

Additional elements may be attached to the surfaces or corner of the informational display panel. For example, as shown in FIGS. 9–12 a finger loop 130 or 160 may be attached at one corner of the informational display panels 110, 140 which enables them to be twirled on a finger during sporting events or political conventions.

INDUSTRIAL APPLICABILITY

The invention disclosed herein, will find wide industrial application in the outer clothing industry which manufactures ordinary appearing outer clothing for individuals which can store informational display panels which can be easily and quickly displayed to disclose one's true identity. Such clothing will find wide industrial application among emergency personnel and undercover policeman and drug agents.

In addition, the invention disclosed herein, will find wide industrial application in the outer clothing industry which manufacturers ordinary appearing outer clothing for individuals which can store informational display panels which can be easily and quickly detached from the jacket. Such outer clothing will find wide industrial application among sports fans with other enthusiasts who enjoy waving flags or banners at events.

In compliance with the statute, the invention has been described in language more or less specific as to structural features. It is to be understood however, that the invention is not limited by specific features shown, since the means and construction herein disclosed comprise form of putting the invention into effect the invention is disclaimed in any of its forms or modification within the legitimate and valid scope of the amended appendix claims, appropriately interpreted in accordance with the Doctrine of Equivalence.

I claim:

1. A jacket having an attached collar and sleeves, comprising:

(a) a pair of front panels attached to a waistband and to a shoulder seam, each said front panel further comprising an upper front panel, a lower front panel, and a front vent panel, said upper front panel interconnected to said lower front panel along a first front panel seam, said front vent panel having an inside surface and an upper edge attached to said shoulder seam and two side edges attached to said collar and said sleeve and a lower edge which extends over and releasable engages said upper front panel, said front vent panel overlaying said upper front panel, whereby an accessible, upward-extending vent pocket is formed;

(b) a rear panel attached to said waistband and to said pair of front panels at said shoulder seam, said rear panel further comprising an upper rear panel and a lower rear panel and a rear vent panel, said upper rear panel interconnected to said lower rear panel along a rear panel seam, said rear vent panel having an inside surface and an upper edge attached to said shoulder seam, two side seams attached to said sleeves and a detachable lower edge which extends downwardly over said rear panel seam, said rear vent panel overlaying said upper rear panel, whereby an accessible, upward-extending vent pocket is formed;

(c) at least one informational display means having an a first edge and a second edge;

(d) a temporary attachment means temporarily attaches said first edge to said front panel seam; and, (e) a hook and loop connector attaching said second detachable edge of said informational display means to said inside surface of said front vent panel, whereby said informational display means may be removed from said vent pocket by detaching said first edge and said second edge.

2. The apparatus of claim 1, wherein said temporary attachment means is a slide fastener.

3. The apparatus of claim 1, wherein said temporary attachment means is a hook and loop connector.

4. The apparatus of claim 1, further comprising: a second informational display means having a first and second edge, said first edge having a temporary attachment means which temporarily attaches said first edge to said second front panel seam, said second edge having a hook and loop connector which attaches said second edge to said inside surface of said second vent pocket, whereby said second informational display panel can be stowed, displayed or removed from said second vent pocket.

5. An outerwear garment having an attached collar and sleeves, comprising:

(a) a rear panel, (b) a pair of front panels attached to said rear panel at a shoulder seam;

(c) at least one front vent panel, said front vent panel having an inside surface and an upper edge attached to said rear panel and one of said front panels at said shoulder seam, said front vent panel having a lower edge which extends over said upper front panel, whereby an accessible, upwardly-extending vent pocket is formed;

(d) at least one informational display means having a first edge and a second edge,.said first edge being unattached; and, (e) a hook and loop connector attaching said second edge of said informational display means to said inside surface of said front vent panel, whereby said informational display means may be removed from said vent pocket to detaching said second edge from said connector.

6. The garment of claim 5 further including a second front vent panel wherein a second upwardly extending vent pocket is formed, and a second informational display means removably disposed within said second upwardly extending vent pocket.

* * * * *